US010826212B2

(12) United States Patent
Chen

(10) Patent No.: US 10,826,212 B2
(45) Date of Patent: Nov. 3, 2020

(54) TOOL-LESS FASTENING DEVICE FOR EDGE CARD

(71) Applicant: ACES ELECTRONICS CO., LTD., Taoyuan (TW)

(72) Inventor: Po-Tsang Chen, Taoyuan (TW)

(73) Assignee: Aces Electronics Co., Ltd., Taoyuan (TW)

( * ) Notice: Subject to any disclaimer, the term of this patent is extended or adjusted under 35 U.S.C. 154(b) by 0 days.

(21) Appl. No.: 16/427,863

(22) Filed: May 31, 2019

(65) Prior Publication Data

US 2019/0372257 A1 Dec. 5, 2019

(30) Foreign Application Priority Data

Jun. 1, 2018 (TW) ..... 107207350 U

(51) Int. Cl.
*H01R 12/72* (2011.01)
*H01R 12/83* (2011.01)
*H01R 12/70* (2011.01)

(52) U.S. Cl.
CPC ..... *H01R 12/721* (2013.01); *H01R 12/7005* (2013.01); *H01R 12/83* (2013.01)

(58) Field of Classification Search
CPC ..... H01R 23/7068; H01R 23/7005; H01R 12/721; H01R 12/83; H01R 12/7005
USPC ..... 439/325, 327, 328
See application file for complete search history.

(56) References Cited

U.S. PATENT DOCUMENTS 5,419,712 A * 5/1995 Bellomo ..... H01R 12/7023 439/327
6,056,579 A * 5/2000 Richards, III ..... H05K 7/1454 439/327
6,176,727 B1 * 1/2001 Liu ..... H01R 12/7005 439/327
6,370,036 B1 * 4/2002 Boe ..... H05K 7/1431 24/563
7,278,872 B2 * 10/2007 Brown ..... G06F 1/185 361/801
7,287,996 B1 * 10/2007 Shing ..... H05K 7/1431 439/327
7,303,412 B1 * 12/2007 Liao ..... H01R 13/62 439/135
7,371,097 B1 * 5/2008 Pennypacker ..... H01R 13/6275 439/327

(Continued)

*Primary Examiner* — Gary F Paumen
(74) *Attorney, Agent, or Firm* — Muncy, Geissler, Olds & Lowe, P.C.

(57) ABSTRACT

A tool-less fastening device for an edge card is provided. The edge card is accommodated in a fastening frame, and the fastening frame is then inserted into an electric connector. In an assembly process, the edge card is fastened with the fastening frame without using any tool, and a user only needs to engage the edge card into the fastening frame; next, the fastening frame is inserted into the electric connector without using any tool, and the user only needs to engage the fastening spring clips disposed on two opposite sides of the fastening frame with two anus of the electric connector, so as to complete a fastening operation. The fastening frame and the electric connector can be prevented from being separated from each other when being shaken during manufacturing or shipment process. Therefore, the edge card can be fastened with the electric connector without using any tool.

10 Claims, 7 Drawing Sheets

(56) References Cited

U.S. PATENT DOCUMENTS

| | | | | |
|---|---|---|---|---|
| 7,396,247 | B2 * | 7/2008 | Lin | H05K 7/1417<br>439/327 |
| 7,641,495 | B1 * | 1/2010 | Sun | H05K 3/366<br>439/327 |
| 2012/0178276 | A1 * | 7/2012 | Lee | H01R 12/7005<br>439/327 |

* cited by examiner

TOOL-LESS FASTENING DEVICE FOR EDGE CARD

This application claims the priority benefit of Taiwan patent application number 107207350, filed on Jun. 1, 2018.

BACKGROUND OF THE INVENTION

1. Field of the Invention

The present invention relates to a tool-less fastening device for an edge card, and more particularly to a structure of engaging a fastening frame with an electric connector, so as to implement the purpose of fastening the edge card into the electric connector without using any tool.

2. Description of the Related Art

In recent years, the computer technology is developing rapidly, and desktop or notebook computers are widely used in all corners of society. The development trend of computers is moving toward high computing power, high speed and small size, so the sizes of the connectors used in the computers are also greatly reduced to meet the development trend of computers. Furthermore, in order to cope with the continuous improvement and advancement of operation functions of the computer, a motherboard of the computer must be able to expand a memory card and an interface card, or a function board, so as to upgrade the overall application functions, operational efficiency and operational capability thereof. In order to expand the memory card, the interface card or the function board on the motherboard, the corresponding connectors are also provided on the motherboard, and various types of memory cards, interface cards or function boards can be electrically inserted in to the connectors for transmitting electronic signals.

The conventional connector of the motherboard usually has a locking device, and the expansion memory card, the interface card or the function card can be docked and locked on the connector by the locking device. However, an industrial computer, an in-vehicle computer or other type of computer is possibly vibrated during operation, so the locking device may be loosed easily, and it causes the memory card, the interface card or the function board to easily release from, jump or get out of the locking device, and results in a failure to form a good electrical connection with the connector.

Furthermore, the edge card connector generally needs to be lowered in height to meet a height limitation defined in the process, and also needs to meet a minimum use area requirement, so a split-type manufacturing solution is proposed. In the split-type manufacturing solution, the surface mount technology (SMT) process is performed on the connector first, and then an assembled edge card fastening frame is inserted into the connector. Therefore, some manufacturers first fix the edge card to a fastening frame having two thread holes formed at two bottom ends thereof, and expose contact points at a bottom of the edge card out of the fastening frame, and then insert the edge card into the edge card connector disposed on a circuit board, and finally the fastening frame is screwed to the screw holes and the circuit board, so as to complete the structure of fastening the edge card with the card edge connector. However, a disadvantage of applying the above-mentioned operation is that an assembly person must hold a locking tool such as a screwdriver, to assemble the edge card and the edge card connector, and the manual locking and assembly operation is time consuming and inefficient, so it is a key issue to be solved in the industry.

SUMMARY OF THE INVENTION

In order to solve the conventional problems, the inventors develop a tool-less fastening device for an edge card, according to collected data, multiple tests and modifications, and years of experience in the industry.

An objective of the present invention is that an edge card can be accommodated in a fastening frame, and the fastening frame is then inserted into an electric connector, and in an assembly process the edge card and the fastening frame can be fastened together without using any hand tools, and the user only needs to engage the edge card into the fastening frame, and then the fastening frame can be inserted into the electric connector without using a hand tool, and the user only needs to engage two fastening spring clips on two opposite sides of the fastening frame with two arms of the electric connector, so as to fasten the fastening frame with the electric connector completely; furthermore, the fastening frame and the electric connector can be prevented from being separated from each other when being shaken or vibrated during manufacturing or shipment process. As a result, the structure of engaging the fastening frame with the electric connector can implement the purpose of fastening the edge card with the electric connector without using any tool.

Another objective of the present invention is that the fastening frame includes two adjustment members symmetrically disposed on a top of a frame body thereof, and an adjustment gap is formed between the two adjustment members and the frame body and configured to provide an elastic space for the two adjustment members being pressed downwardly, and when the edge card located inside the fastening frame is pressed to a bottom dead point, two bottom ends of the edge card can be indeed abutted with two abutting plates of the fastening frame, so as to make contact points of the edge card and terminals of the electric connector in good contact without any skew contact, thereby ensuring that the edge card can operate stably in processing high-frequency signal.

Another objective of the present invention is that a thickness of a first frame part located on a side of an accommodating groove of the frame body is lower than a thickness of a second frame part located on other side of the accommodating groove of the frame body, and a base of the electric connector comprises a stop plate disposed on a side thereof, the stop plate has two fastening grooves formed on two ends, respectively, and each of the two fastening grooves has a width only enough to engage and locate the first frame part, and the second frame part is blocked and limited on a top surface of the stop plate, so as to form an anti-reverse-insertion structure for inserting the fastening frame into the electric connector.

Another objective of the present invention is that the two adjustment members have protruding parts disposed on two opposite outer sides thereof, respectively, and configured to serve as fulcrums for applying force to pull the fastening frame out of the electric connector.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
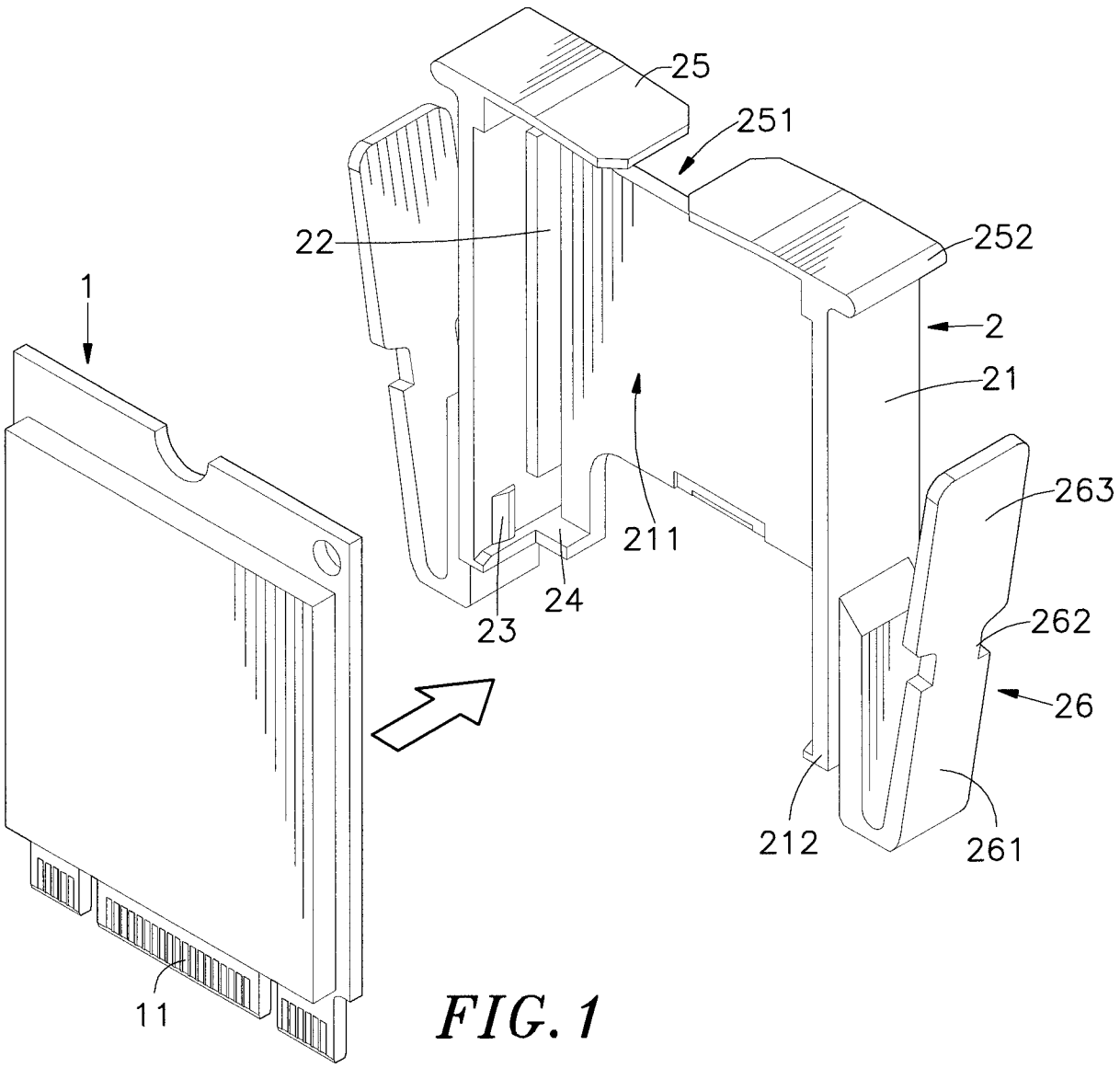
FIG. 1 is a perspective exploded structural diagram of an operation of assembling an edge card with a fastening frame, according to an embodiment of the present invention.
Figure 2:
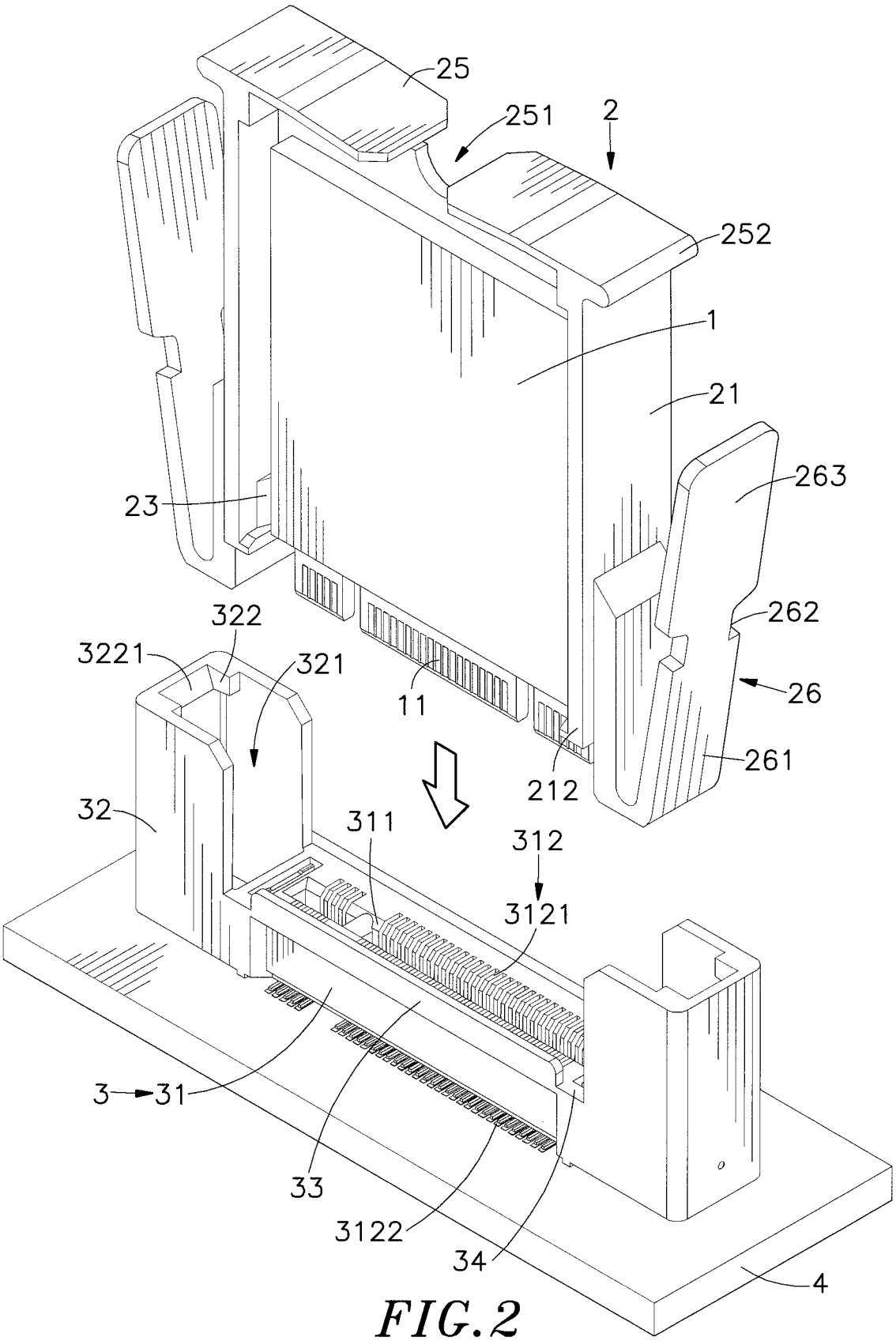
FIG. 2 is a perspective exploded structural diagram of an operation of assembling a fastening frame with an electric connector, according to an embodiment of the present invention.
Figure 3:
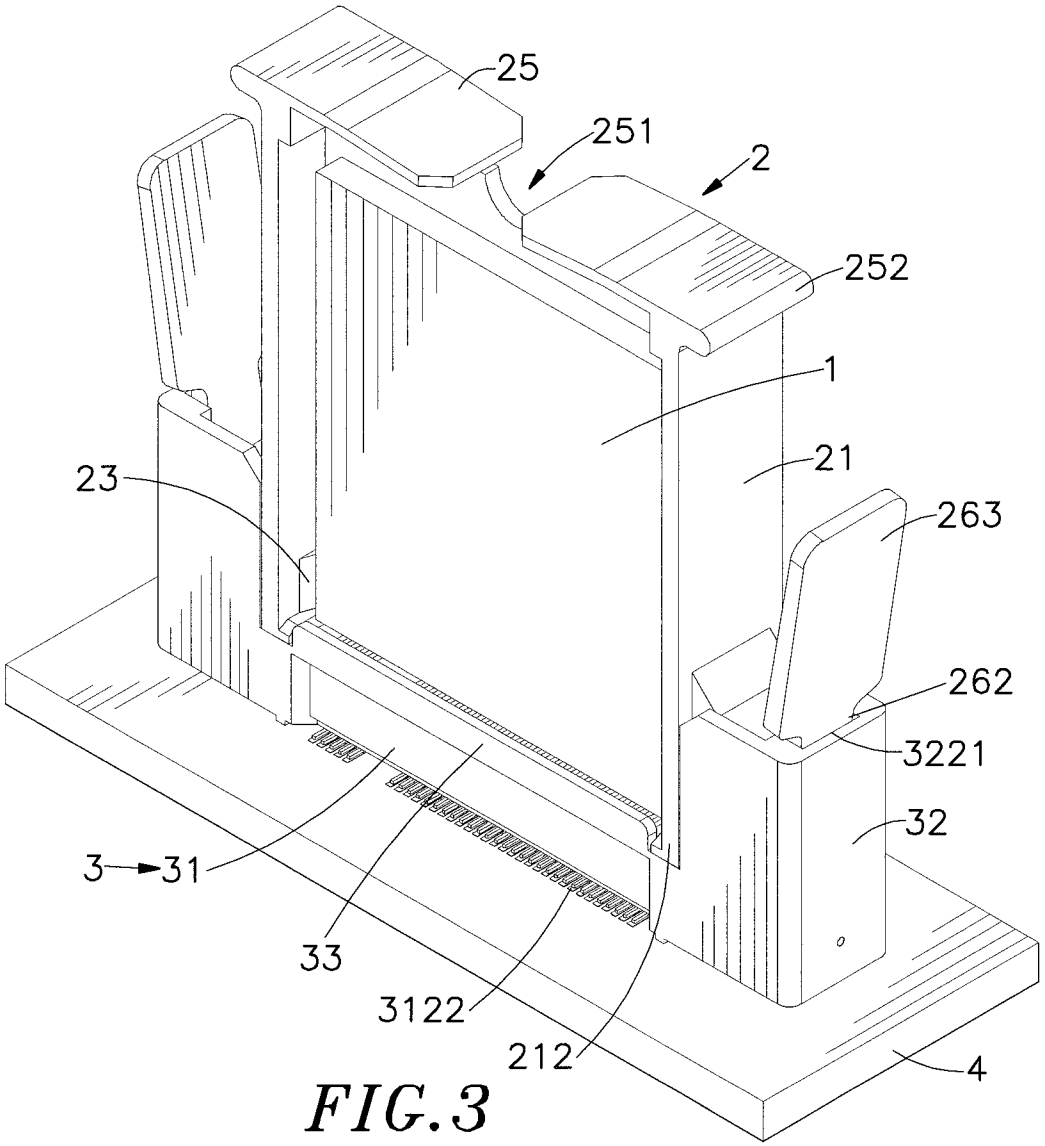
FIG. 3 is a perspective structural diagram of a fastening frame assembled with an electric connector, according to an embodiment of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise" and variations such as "comprises" or "comprising", will be acknowledged to imply the inclusion of stated elements but not the exclusion of any other elements.

Please refer to FIGS. 1 to 3, and 5, which are a perspective exploded structural diagram of an operation of assembling an edge card with a fastening frame, a perspective exploded structural diagram of an operation of assembling the fastening frame with an electric connector, a perspective structural diagram of the fastening frame assembled with the electric connector, and a structural diagram of contact points of the edge card electrically connected to terminals of the electric connector, according to an embodiment of the present invention, respectively. As shown in the figures, the tool-less fastening device of the present invention can include an edge card 1, a fastening frame 2 and an electric connector 3.

The fastening frame 2 can include a frame body 21 configured to accommodate the edge card 1, and the frame body 21 can include two fastening spring clips 26 disposed on two outer sides thereof, respectively, and each fastening spring clip 26 can include a supporting part 261, a fastening part 262 and a releasing part 263. The frame body 21 can have an accommodating groove 211 formed on a side thereof and configured to accommodate the edge card 1. The accommodating groove 211 has two stop plates 22 and two position-limiting blocks 23 disposed on two sides thereof, respectively, and configured to abut with two surfaces of the edge card 1. In an embodiment, the position-limiting block 23 can be implemented by a triangular cylinder; however, a person have ordinary skill in the art can effortlessly implement the position-limiting block 23 by other structure, and the present invention is not limited to the triangular cylinder, and any geometric structure can be used to limit the edge card 1 on the fastening frame 2 without departing from the spirit and scope of the disclosure set forth in the claims. The accommodating groove 211 can have two abutting plates 24 disposed on two sides thereof and configured to abut with two bottom ends of the edge card 1.

The frame body 21 comprises at least one adjustment member 25 disposed on a top thereof, and when the at least one adjustment member 25 is pressed downwardly, the top of the edge card 1 can be forced to move downwardly, so that two bottom ends of the edge card 1 can be abutted with the two abutting plates 24 at the same time. In an embodiment, the adjustment member 25 can be implemented by an adjustment spring clip. In a preferred embodiment, the number of the adjustment member 25 is two, and the two adjustment members 25 are symmetrically disposed on the top of the frame body 21, and an adjustment gap 251 can be formed between the two adjustment members 25 and the frame body 21, and configured to provide an elastic space for the two adjustment members 25 being pressed downwardly. The two adjustment members 25 can have protruding parts 252 disposed on two opposite outer sides thereof, respectively, and configured to serve as fulcrums for applying force to pull the fastening frame 2 out of the electric connector 3.

The electric connector 3 can include a base 31. The base 31 can include an insertion slot 311 disposed inside thereof, and a terminal set 312 disposed inside the insertion slot 311 and configured for insertion of the edge card 1. The electric connector 3 can include two arms 32 disposed on two ends of the base 31, respectively. Each of the two arms 32 has an accommodation space 321 configured to engage and locate one of the two fastening spring clips 26. Each arm 32 has a fastening groove 322 formed on an inner wall of the accommodation space 321 thereof, and the fastening groove 322 can have a stop part 3221 disposed thereon. The supporting part 261 of each fastening spring clip 26 is inserted into the accommodation space 321 of one of the two arms 32, and each fastening part 262 is abutted with the fastening groove 322 and the stop part 3221, so as to form a fastening structure.

The insertion slot 311 can be laterally formed on a surface of the base 31 and configured for insertion of the edge card 1. The terminal set 312 comprises a joint part 3121 disposed on a side thereof and extended into the insertion slot 311, and configured to form electrical contact with contact points of the edge card 1. The terminal set 312 also comprises a solder part 3122 disposed on other side thereof and extended out of the base 31, and configured to form connection with a plurality of solder pads 41 of a circuit board 4.

Figure 4:
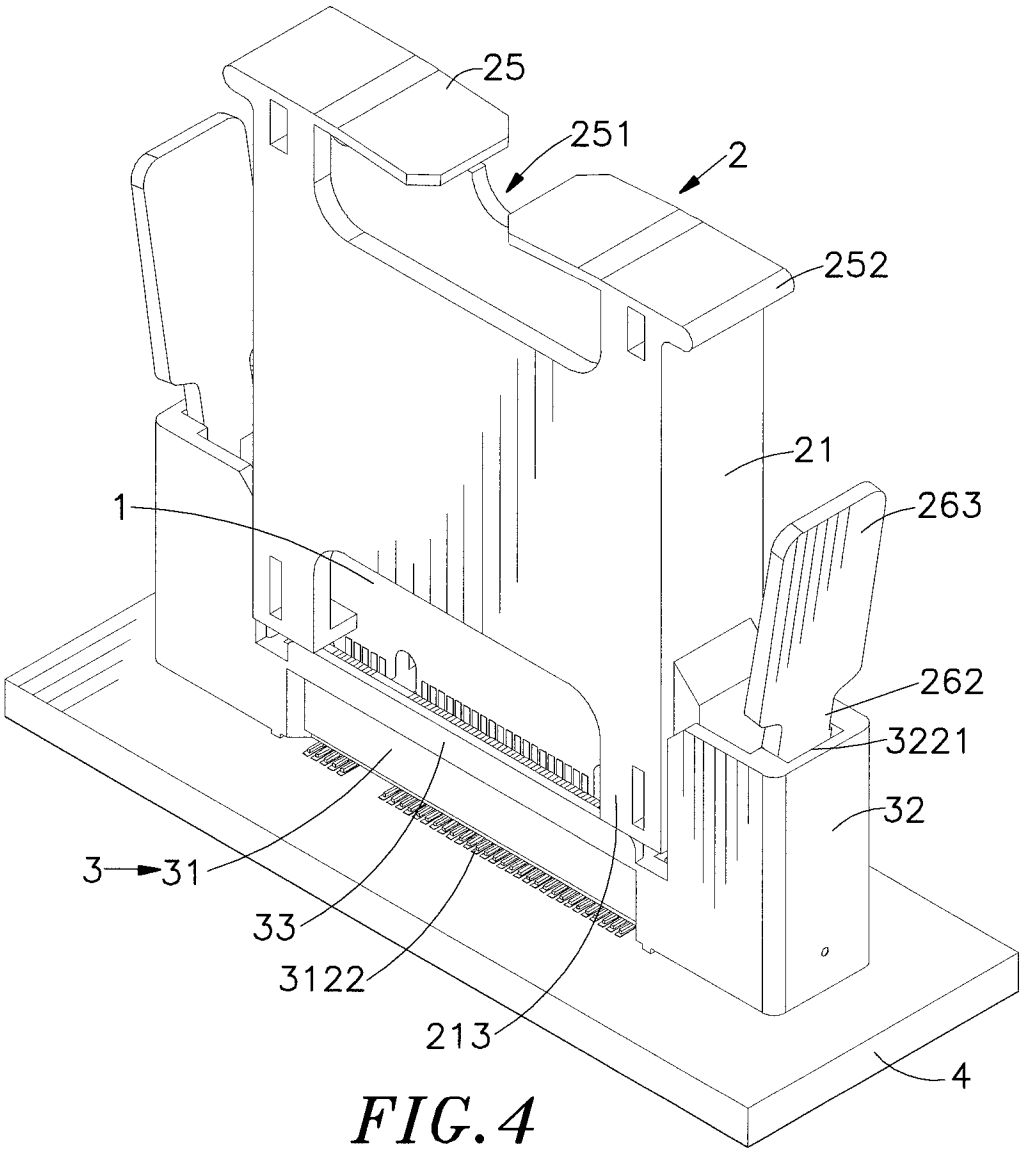
FIG. 4 is a schematic structural view of an anti-reverse-insertion structure formed between a fastening frame and an electric connector, according to an embodiment of the present invention.
Figure 5:
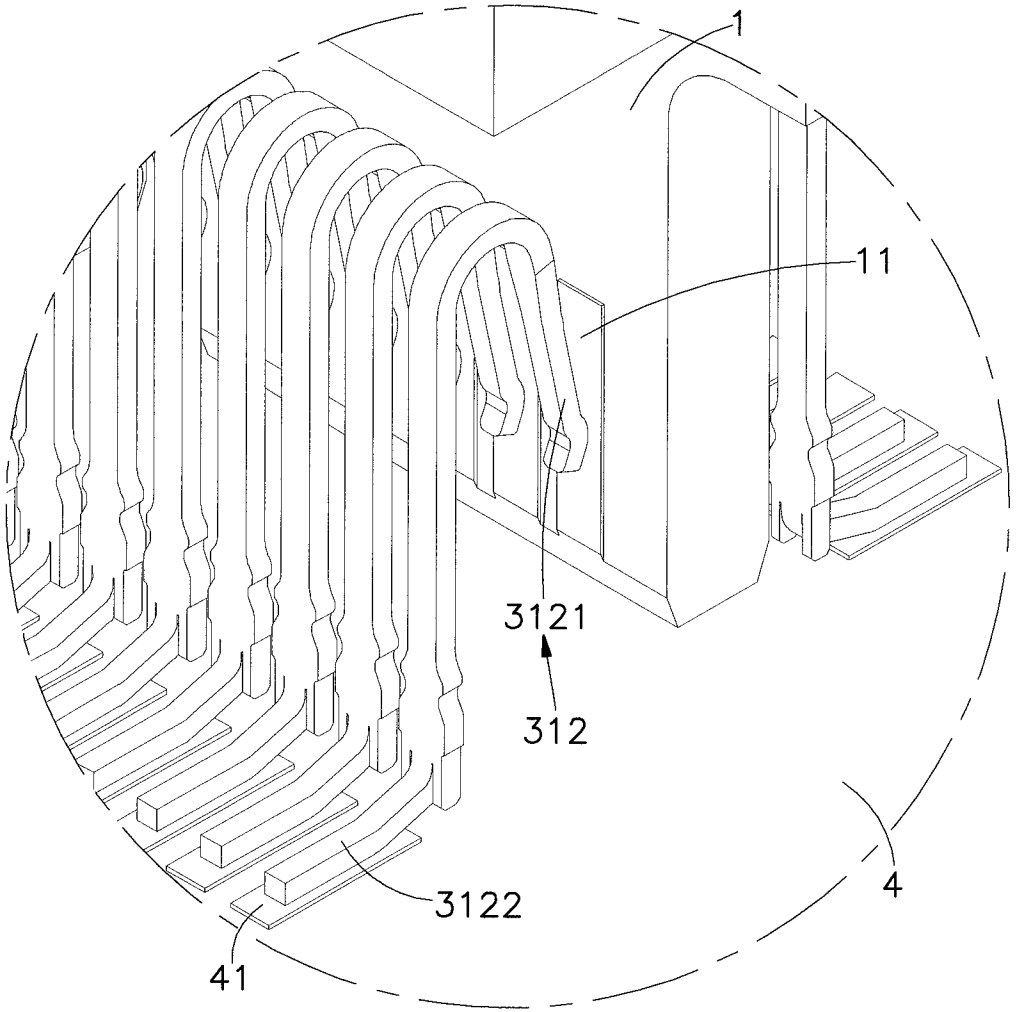
FIG. 5 is a structural diagram of contact points of an edge card electrically connected to terminals of an electric connector, according to an embodiment of the present invention.

Please refer to FIG. 4, which is a schematic structural view of an anti-reverse-insertion structure formed between the fastening frame and the electric connector, according to an embodiment of the present invention. A thickness of a first frame part 212 located on a side of the accommodating groove 211 of the frame body 21 is lower than a thickness of a second frame part 213 located on other side of the accommodating groove 211 of the frame body 21. The base 31 of the electric connector 3 comprises a stop plate 33 disposed on a side thereof. The stop plate 33 has fastening grooves 34 formed on two ends, respectively, and each of the two fastening grooves 34 has a width only enough to engage and locate the first frame part 212, and the second frame part 213 is blocked and limited on a top surface of the stop plate 33, so as to form the anti-reverse-insertion structure for inserting the fastening frame 2 into the electric connector 3.

Please refer back to FIG. 5. When the two adjustment members 25 disposed on the frame body 21 of the fastening frame 2 press the edge card 1 inside the fastening frame 2 downwardly to a bottom dead point, the two bottom ends of the edge card 1 can be indeed abutted with the two abutting plates 24 of the fastening frame 2, so as to make a contact points 11 of the edge card 1 and the joint part 3121 of the terminal set 312 of the electric connector 3 in good contact without any skew contact, thereby ensuring that the edge card 1 can operate stably in processing high-frequency signal.

Figure 6:
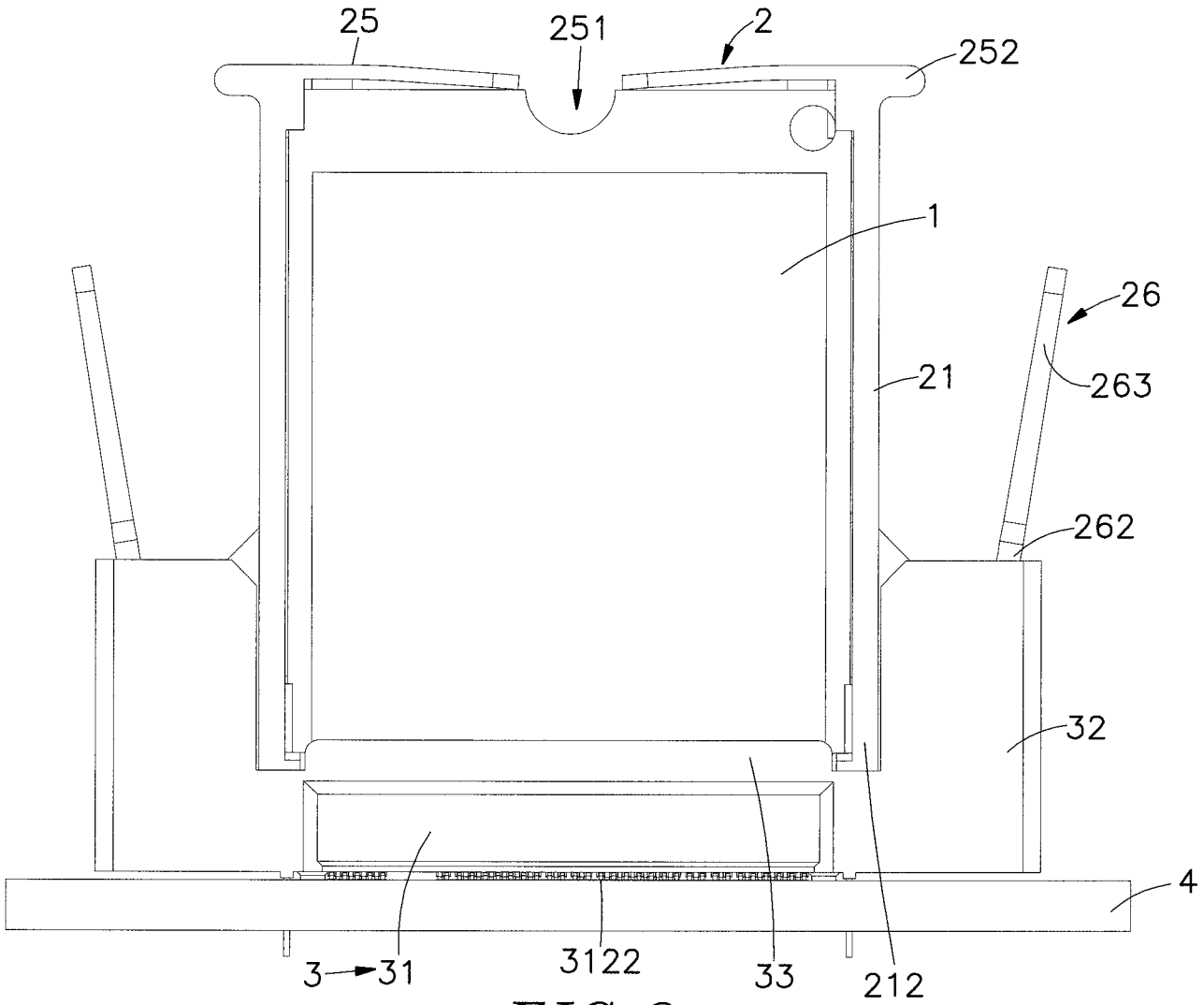
FIG. 6 is a front view of an operation of assembling a fastening frame with an electric connector, according to an embodiment of the present invention.
Figure 7:
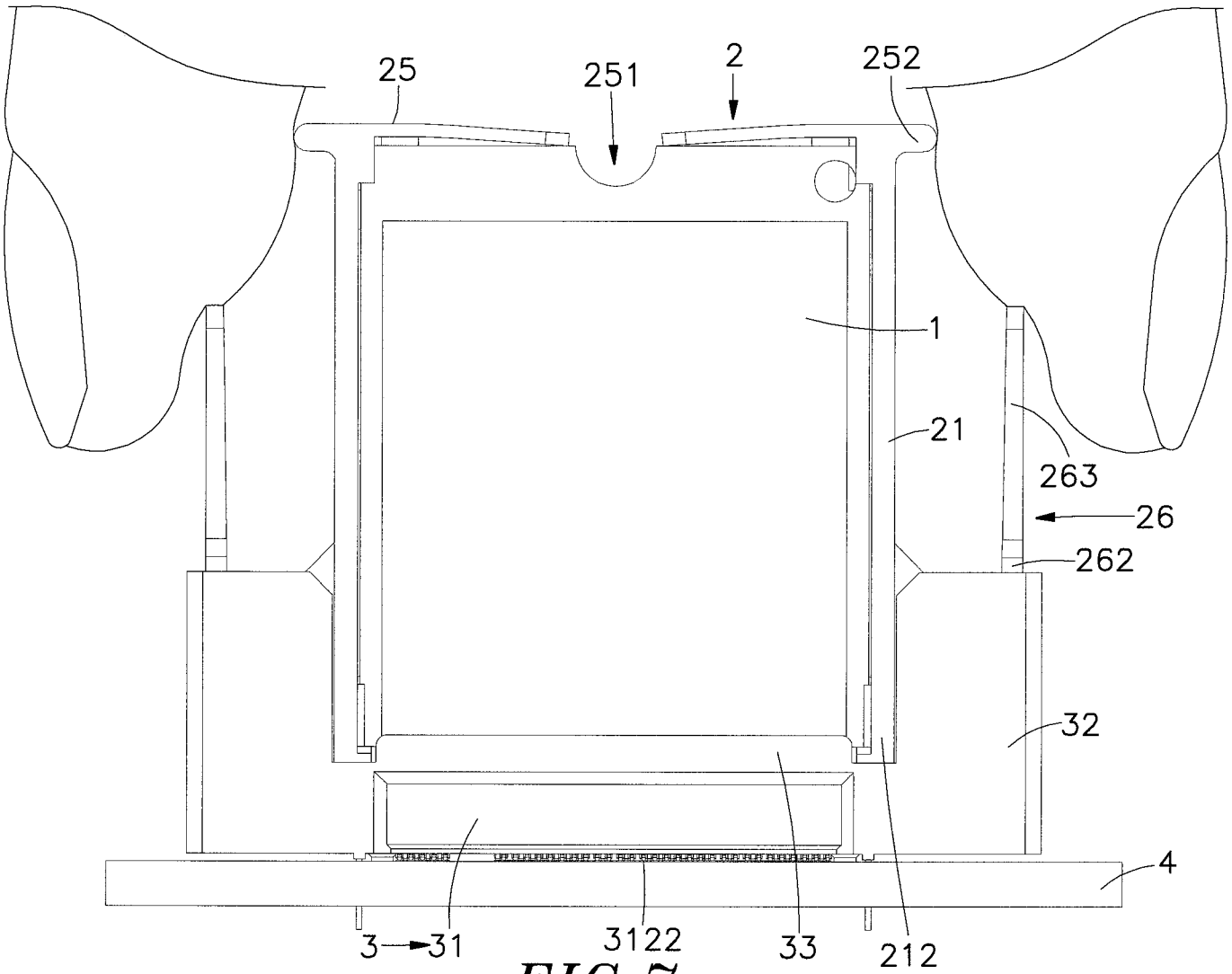
FIG. 7 is a front view of an operation of pulling a fastening frame out of an electric connector, according to an embodiment of the present invention.

Please refer to FIGS. 6 and 7, which are a front view of an operation of assembling the fastening frame with the electric connector, and a front view of an operation of pulling the fastening frame out of the electric connector, according to an embodiment of the present invention. The edge card 1 is accommodated in the fastening frame 2 first, the fastening frame 2 is then inserted into the electric connector 3. In an assembly process, the edge card 1 can be fastened with the fastening frame 2 without using any hand tool, and the user only needs to engage the edge card 1 into the fastening frame 2. Next, the fastening frame 2 can be inserted into the electric connector 3 without using hand tools, and the user only needs to engage the fastening spring clips 26, which are disposed on two opposite sides of the fastening frame 2, with the two arms 32 of the electric connector 3, so as to fasten the edge card 1 with the electric connector 3 completely. Furthermore, the fastening frame 2 and the electric connector 3 can be prevented from being separated from each other when being shaken or vibrated during manufacturing or shipment process. As a result, the above-mentioned structure of engaging the fastening frame 2 with the electric connector 3 can implement the purpose of fastening the edge card 1 into the electric connector 3 without using any tool.

As mentioned above, for the purpose of pulling the fastening frame 2 out of the electric connector 3, the two adjustment members 25 can have protruding parts 252 disposed op two opposite outer sides thereof, respectively, and configured to serve as fulcrums for applying force to pull the fastening frame 2 out of the electric connector 3, and the user can apply force, by two fingers thereof, to press the releasing parts 263 of the two fastening spring clips 26 from an outwardly-titled status to a vertical status, and then move the fastening parts 262 of the fastening spring clips 26 out of the fastening grooves 322 of the arms 32, so that the fastening frame 2 can be vertically and upwardly pulled out of the electric connector 3. Next, the user can pull the edge card 1 out of the accommodating groove 211 of the fastening frame 2, to complete the operation of disassembling the edge card 1.

The present invention disclosed herein has been described by means of specific embodiments. However, numerous modifications, variations and enhancements cap be made thereto by those skilled in the art without departing from the spirit and scope of the disclosure set forth in the claims.

What is claimed is:

1. A tool-less fastening device for an edge card, comprising:

a fastening frame comprising a frame body configured to accommodate an edge card, wherein the frame body comprises two fastening spring clips disposed on two outer sides thereof, respectively; and an electric connector comprising a base which comprises an insertion slot disposed inside thereof and a terminal set disposed inside the insertion slot and configured for insertion of the edge card, and the electric connector comprising two arms disposed on two ends of the base, respectively, wherein each of the two arms has an accommodation space configured to engage and locate one of the two fastening spring clips, wherein the frame body comprises at least one adjustment member disposed on a top thereof, and when the at least one adjustment member is pressed, a top of the edge card is pressed to move downwardly, so as to force two bottom ends of the edge card to abut with two abutting plates at the same time, wherein a number of the at least one adjustment member is two, and the two adjustment members are symmetrically disposed on the top of the frame body, and an adjustment gap is formed between the two adjustment members and the frame body, and configured to provide an elastic space for the two adjustment members being pressed downwardly.

2. The tool-less fastening device according to claim 1, wherein the frame body has an accommodating groove formed on a side thereof and configured to accommodate the edge card.

3. The fastening device according to claim 2, wherein the accommodating groove comprises two stop plates and two position-limiting blocks disposed on two sides thereof, respectively, and configured to abut with two surfaces of the edge card.

4. The fastening device according to claim 2, wherein the accommodating groove comprises two abutting plates disposed on two sides thereof and configured to abut with the two bottom ends of the edge card.

5. The tool-less fastening device according to claim 1, wherein the at least one adjustment member is an adjustment spring clip.

6. The tool-less fastening device according to claim 1, wherein the two adjustment members have protruding parts disposed on two opposite outer sides thereof, respectively, and the two protruding parts serve as fulcrums for applying force to pull a fastening frame out of an electric connector.

7. The tool-less fastening device according to claim 1, wherein each of the two arms has a fastening groove formed on an inner wall of the accommodation space thereof and comprising a stop part disposed thereon.

8. The tool-less fastening device according to claim 1, wherein the frame body comprises the two fastening spring clips disposed on two outer sides thereof, respectively, and each of the two fastening spring clips comprises a supporting part, a fastening part and a releasing part, the supporting parts of the two fastening spring clips are configured to insert into the accommodation spaces of the two arms, and the fastening parts of the two fastening spring clips are configured to abut with the fastening grooves and stop parts, so as to form a fastening structure.

9. The tool-less fastening device according to claim 1, wherein the insertion slot is laterally formed on a surface of the base and configured for insertion of the edge card, and the terminal set comprises a joint part disposed on a side thereof and extended into the insertion slot, and configured to form electrical contact with contact points of the edge card, and the terminal set comprise a solder part disposed on other side of the terminal set and extended out of the base, and configured to form connection with solder pads of a circuit board.

10. The tool-less fastening device according to claim 1, wherein a thickness of a first frame part located on a side of an accommodating groove of the frame body is lower than a thickness of a second frame part located on other side of the accommodating groove of the frame body, and the base of the electric connector comprises a stop plate disposed on a side thereof and having two fastening grooves formed on two ends, respectively, and each of the two fastening grooves has a width only enough to engage and locate the first frame part only, the second frame part is blocked and limited on a top surface of the stop plate, so as to form an anti-reverse-insertion structure for inserting the fastening frame into the electric connector.

* * * * *